US005531565A

United States Patent [19]

Meindl et al.

[11] Patent Number: 5,531,565

[45] Date of Patent: Jul. 2, 1996

[54] APPLIANCE FOR EXTRACTING SECONDARY AIR FROM AN AXIAL COMPRESSOR

[75] Inventors: Thomas Meindl, Nussbaumen; Pierre Meylan, Neuenhof; Thomas Zierer, Wettingen, all of Switzerland

[73] Assignee: ABB Management AG, Baden, Switzerland

[21] Appl. No.: 284,221

[22] Filed: Aug. 2, 1994

[30] Foreign Application Priority Data

Aug. 10, 1993 [DE] Germany ..... 43 26 799.8

[51] Int. Cl.[6] ..... F01D 9/04

[52] U.S. Cl. ..... 415/144; 415/208.2; 415/211.2; 415/226; 60/39.07

[58] Field of Search ..... 415/144, 145, 415/115, 116, 208.2, 208.3, 208.4, 211.2, 226; 60/39.07

[56] References Cited

U.S. PATENT DOCUMENTS

| | | | |
|---|---|---|---|
| 3,142,438 | 7/1964 | McKenzie | 415/144 |
| 3,632,223 | 1/1972 | Hampton | 415/144 |
| 3,966,355 | 6/1976 | Pierpoline | 415/144 |
| 4,463,552 | 8/1984 | Monhardt et al. | 60/39.07 |
| 5,155,993 | 10/1992 | Baughman | 60/39.07 |

FOREIGN PATENT DOCUMENTS

| | | | |
|---|---|---|---|
| 1428216 | 7/1969 | Germany . | |
| 2031612 | 4/1971 | Germany . | |
| 3243279A1 | 6/1983 | Germany . | |
| 4038353A1 | 10/1991 | Germany . | |
| 0168999 | 7/1987 | Japan | 415/145 |
| 0219739 | 6/1942 | Switzerland | 415/211.2 |
| 0953231 | 8/1982 | U.S.S.R. | 415/144 |
| 0531254 | 1/1941 | United Kingdom | 415/208.3 |
| 2192229 | 1/1988 | United Kingdom . | |

*Primary Examiner*—Edward K. Look
*Assistant Examiner*—Christopher Verdier
*Attorney, Agent, or Firm*—Burns, Doane, Swecker & Mathis

[57] ABSTRACT

In an axial-flow compressor, the appliance for extracting secondary air using a peripheral extraction slot which is at least partially configured as a diagonal diffuser is such that means which make it possible to utilize the kinetic energy of the peripheral component of the flow velocity are arranged in or directly at the extraction slot (4). These can, for example, be a mini-cascade (7) integrated in the extraction slot (4) or an extraction slot (4) which is designed as a diagonal diffuser (8) and merges into a volute (9), the volute (9) opening directly into the extraction tube (6). The total pressure loss is minimized and the efficiency of the installation is increased by these arrangements.

3 Claims, 2 Drawing Sheets

APPLIANCE FOR EXTRACTING SECONDARY AIR FROM AN AXIAL COMPRESSOR

BACKGROUND OF THE INVENTION

1. Field of the Invention

The invention relates to an appliance for extracting secondary air from an axial compressor, a peripheral slot being used for the extraction.

2. Discussion of Background

In compressors, secondary air is extracted to provide cooling air for the turbine. A certain total pressure is necessary, depending on the cooling duty. A peripheral slot is usually employed for extracting the secondary air. The extracted air passes through the extraction slot into the extraction plenum and from there via the extraction tube into the cooling system of the turbine. Unfortunately, a large part of the dynamic pressure is lost during the extraction.

The criteria for optimizing the extraction slot are very contradictory because, on the one hand, the flow in the extraction slot must be optimized but, on the other, the flow in the bladed annular space of the compressor must not be disturbed. This problem is particularly severe where the extraction slot is also used as the blow-off system when the compressor is being run up and run down.

Various forms of such connections between the main duct and the blow-off system have therefore been evolved, such as slots of different shapes, hollow guide vanes and openings in the platforms at the roots of the guide vanes.

If the extraction slots most frequently used are considered, it is found that although a part of the axial component of the flow velocity can be used—depending on the geometry of the slot (particularly the opening angle of the extraction slot and the angle of inclination of the slot relative to the center line of the compressor)—the peripheral component is almost completely dissipated. In modern compressors, however, the energy content of the peripheral component is, in fact, very large so that this leads to significant losses of total pressure. The pressure losses are, inter alia, directly proportional to the square of the peripheral component of the flow velocity in the compressor.

SUMMARY OF THE INVENTION

Accordingly, one object of the invention is to avoid this disadvantage and to provide a novel appliance for the extraction of secondary air from an axial compressor using a peripheral extraction slot which is at least partially configured as a diagonal diffuser, the total pressure loss being minimized in this appliance.

This is achieved, in accordance with the invention, by arranging means in or directly at the extraction slot in the appliance, which means make it possible to utilize the kinetic energy of the peripheral component of the flow velocity.

The advantages of the invention may be seen in the fact that the total pressure loss is minimized by converting the peripheral component of the rotor or guide vane outlet flow in the compressor into static pressure and, by this means, the efficiency of the installation is increased.

It is particularly expedient for the means to convert the kinetic energy of the peripheral component of the flow velocity to be a mini-cascade which is arranged directly in the constant-height inlet region of the extraction slot. The peripheral velocity is converted into static pressure by this means and the total pressure loss is therefore minimized.

Furthermore, it is advantageous for the mini-cascade to be arranged at the inlet of the extraction slot on the compressor guide vane row; the compressor guide vane cascade and the mini-cascade can have different deflection angles and/or different numbers of vanes.

In addition, it is expedient for the mini-cascade to be arranged at the end of the extraction slot, which diverges over its entire length.

Finally, the extraction slot is advantageously designed as a diagonal diffuser which merges into a volute, the volute opening directly into the extraction tube. By this means, a part of the peripheral velocity is converted into static pressure and a part of the peripheral velocity becomes the transport component.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings which show three embodiments of the invention using a single-shaft axial-flow gas turbine compressor and wherein.

DESCRIPTION OF THE PREFERRED EMBODIMENTS

Figure 1:
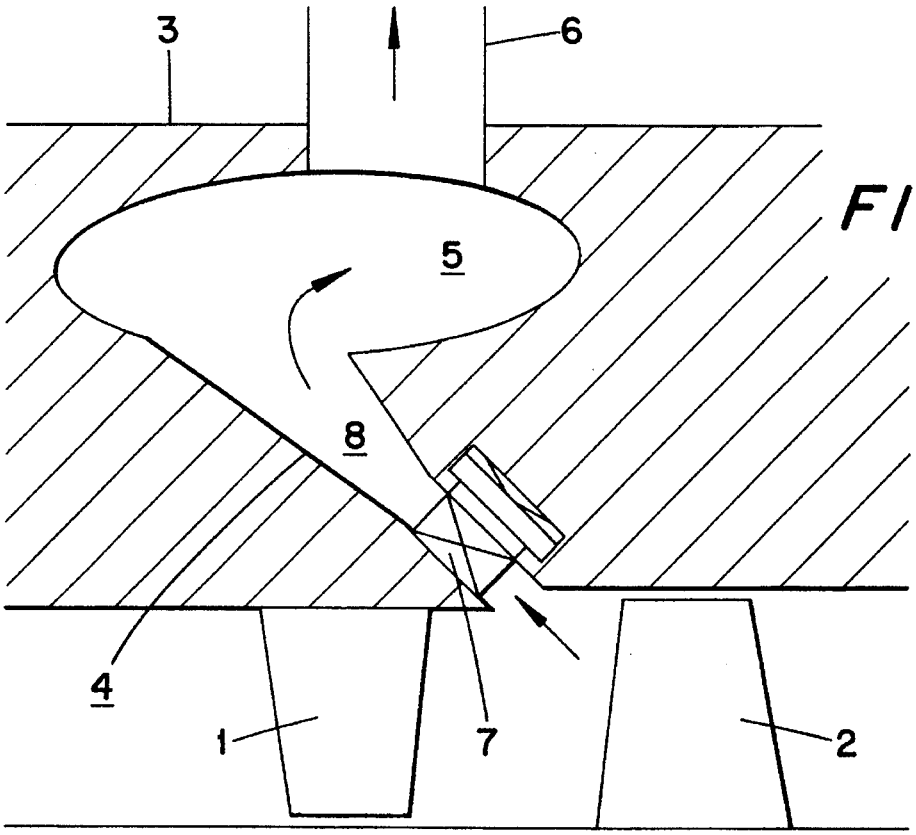
FIG. 1 shows a partial longitudinal section of the gas turbine compressor with a mini-cascade in the inlet slot.

Referring now to the drawings, wherein like reference numerals designate identical or corresponding parts throughout the several views, where only the elements essential to understanding the invention are shown and in which the flow direction of the working medium is indicated by arrows, a partial longitudinal section of a gas turbine compressor is shown in FIG. 1. A peripheral extraction slot 4, which opens into an extraction plenum 5, is arranged in the gas turbine casing 3 between the guide vane row 1 and the rotor wheel 2 of the compressor. The extraction plenum 5 is in turn connected to the extraction tube 6. The inlet region of the extraction slot 4 has a constant height. A mini-cascade 7 is arranged there. The part of the extraction slot 4 adjoining the mini-cascade is configured as a diagonal diffuser 8.

When the secondary air is extracted, the flow at the inlet into the extraction slot 4 is directed axially by the mini-cascade 7. This converts the peripheral component of the flow velocity into static pressure and reduces the total pressure loss. The mini-cascade is particularly effective where there is a strong swirl in the flow.

The optimum position of the mini-cascade follows from the detailed layout. In a further embodiment example, therefore, the extraction slot 4 can be configured as a divergent passage over its complete length with the mini-cascade arranged at its end.

Figure 2:
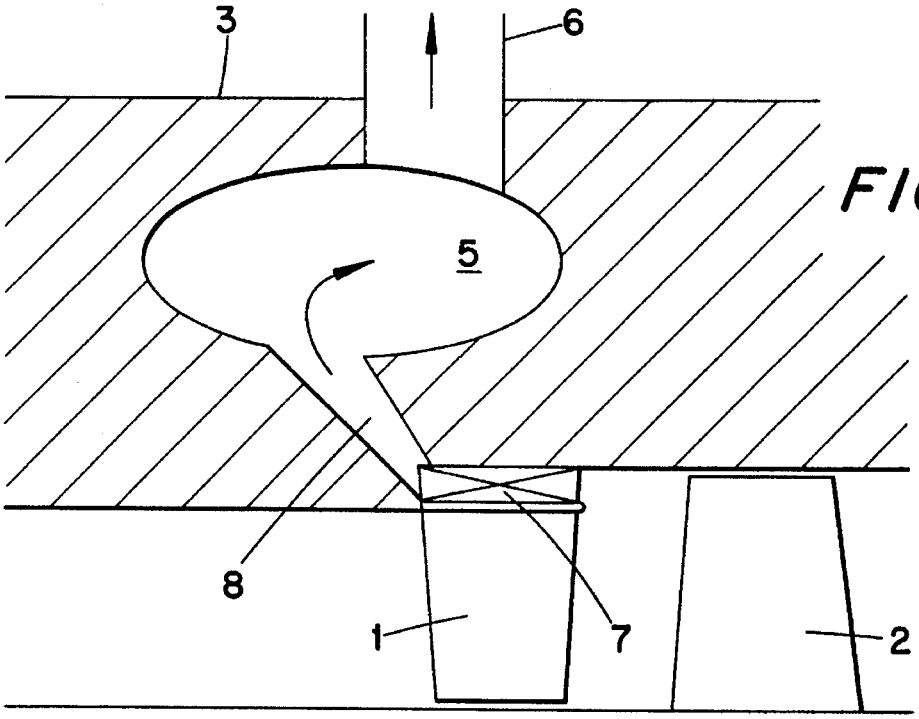
FIG. 2 shows a partial longitudinal section of the gas turbine compressor with a mini-cascade on the compressor guide vane row.

A different embodiment example of the invention is shown in FIG. 2. In this case, the mini-cascade 7 is combined with the guide vane cascade of the compressor. The compressor guide vane row 1 is divided. The lower part is used for the compressor deflection whereas the upper part shows the mini-cascade 7 for deflecting the flow into the axial direction. Because the guide vane cascade of the compressor does not usually deflect into the axial direction, the guide vane cascade and the mini-cascade 7 have different deflection angles. Likewise, the vane numbers of the guide vane cascade and the mini-cascade 7 can be different. In this embodiment example, the peripheral component of the rotor-wheel outlet flow in the compressor is again converted into static pressure and the total pressure loss is minimized.

Figure 3:
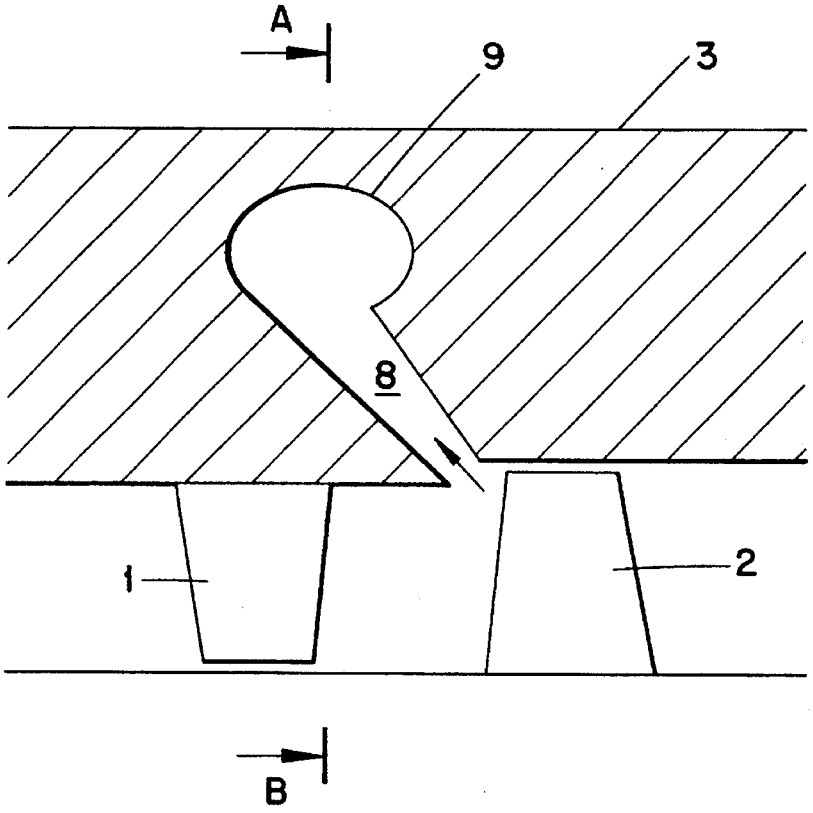
FIG. 3 shows a partial longitudinal section of the gas turbine compressor with an extraction slot designed as a diagonal diffuser which merges into a volute, the volute opening directly into the extraction tube.
Figure 4:
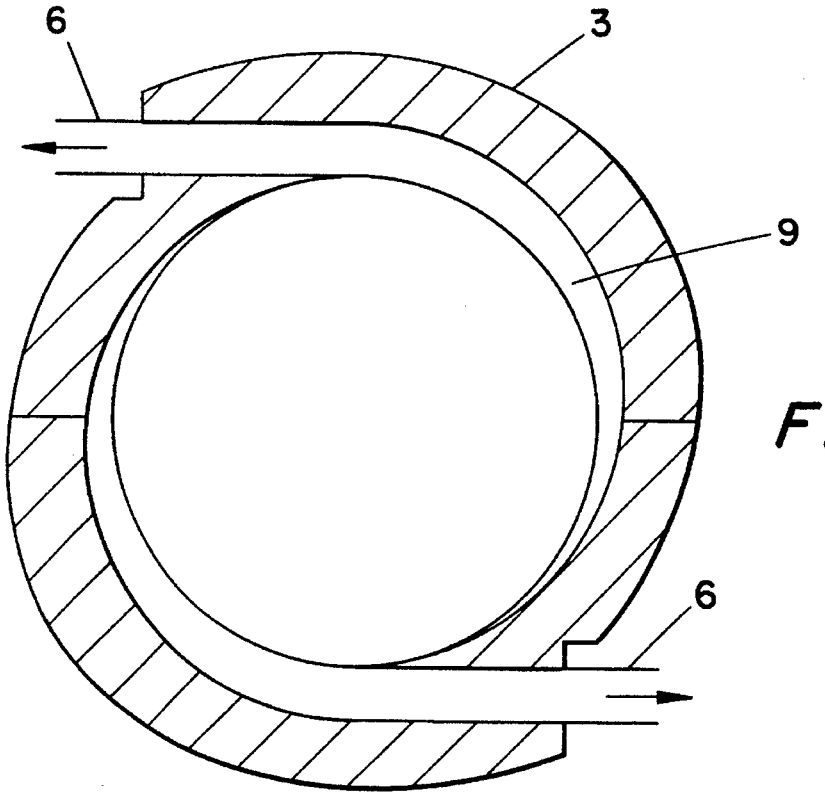
FIG. 4 shows a partial cross-section (section A–B) through FIG. 3.

A fourth embodiment example is illustrated in FIGS. 3 and 4. In this case, the extraction slot 4 is not embodied in the usual way by combining the extraction slot 4 and the extraction plenum 5 (see FIGS. 1 and 2). On the contrary, the extraction slot 4, which is designed as a diagonal diffuser 8, merges into a volute 9. This volute 9 opens directly into the extraction tube 6. Here again, part of the peripheral component of the flow velocity is converted at low loss into static pressure and a further part becomes the transport component. The total pressure loss is reduced and, furthermore, the flow outlet loss, which would occur on passage into the extraction plenum 5, does not arise. The efficiency of the installation is therefore increased relative to the prior art. In the case where a volute 9 is employed, it is possible to dispense with the mini-cascade 7.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An appliance for extracting secondary air from an axial compressor using a peripheral extraction slot which is at least partially configured as a diagonal diffuser, wherein a cascade of vanes for converting kinetic energy of a peripheral component of a flow velocity to static pressure are positioned on a compressor guide vane row at an inlet of the extraction slot, wherein the compressor guide vane row has a different deflection angle than the cascade vanes, the cascade vanes being angled to direct the peripheral flow at the inlet of the extraction slot in an axial direction.

2. The appliance as claimed in claim 1, wherein the guide vane row of the compressor and the cascade have different numbers of vanes.

3. The appliance as claimed in claim 1, wherein the extraction slot designed as a diagonal diffuser merges into a volute, the volute providing flow in a single rotation direction and opening directly into two extraction tubes.

* * * * *